US011053050B2

(12) United States Patent
Kutsuna et al.

(10) Patent No.: US 11,053,050 B2
(45) Date of Patent: Jul. 6, 2021

(54) LIQUID CONTAINER AND ANTI-LOOSENING CAP FOR SAME

(71) Applicant: AICELLO CORPORATION, Toyohashi (JP)

(72) Inventors: Yoshimichi Kutsuna, Toyohashi (JP); Go Ota, Toyohashi (JP)

(73) Assignee: AICELLO CORPORATION, Toyohashi (JP)

( * ) Notice: Subject to any disclaimer, the term of this patent is extended or adjusted under 35 U.S.C. 154(b) by 0 days.

(21) Appl. No.: 16/634,364

(22) PCT Filed: Oct. 26, 2017

(86) PCT No.: PCT/JP2017/038636
§ 371 (c)(1),
(2) Date: Jan. 27, 2020

(87) PCT Pub. No.: WO2019/021499
PCT Pub. Date: Jan. 31, 2019

(65) Prior Publication Data

US 2020/0377264 A1 Dec. 3, 2020

(30) Foreign Application Priority Data

Jul. 26, 2017 (JP) ..... JP2017-144661

(51) Int. Cl.
*B65D 41/04* (2006.01)
*B65D 1/02* (2006.01)

(52) U.S. Cl.
CPC ..... *B65D 41/0471* (2013.01); *B65D 1/0246* (2013.01); *B65D 41/045* (2013.01)

(58) Field of Classification Search
CPC . B65D 41/0471; B65D 41/045; B65D 1/0246
(Continued)

(56) References Cited

U.S. PATENT DOCUMENTS 2,465,662 A * 3/1949 Sanford ..... B65D 41/0435 215/270
3,243,070 A * 3/1966 Hoyle ..... B65D 41/14 215/326
3,255,908 A * 6/1966 Braun ..... B65D 41/0471 215/329

FOREIGN PATENT DOCUMENTS

FR 2978128 * 1/2013 ..... B65D 41/045
JP S55-110453 U 8/1980
(Continued)

OTHER PUBLICATIONS

Jan. 16, 2018 International Search Report issued in International Patent Application No. PCT/JP2017/038636.
(Continued)

*Primary Examiner* — James N Smalley
*Assistant Examiner* — Elizabeth J Volz
(74) *Attorney, Agent, or Firm* — Oliff PLC

(57) ABSTRACT

A liquid container is screwed to tighten and seals strongly, and wherein torque reduction for opening the cap is controlled to prevent loosening the cap, preservation of a tightly-sealing property is improved, and content leak is prevented. The container includes: a body having a male screw on the mouth-neck section rising from the surface; and an anti-loosening cap having a female screw engaging with the male screw and a buffer seal material on the inner side of a top plate, a flange protruding from an open end portion of an outer cylinder skirt extending from the top plate, a resin cushion material protrusion on the flange and attached onto the outer surface of the flange, a height difference of the top plate inner surface to the protrusion top is larger than a height difference from a container opening end face of the mouth-neck to an outer surface portion and protrusion.

12 Claims, 3 Drawing Sheets

(58) Field of Classification Search
USPC ..... 220/304, 378, 288; 215/350, 252, 329
See application file for complete search history.

(56) References Cited

FOREIGN PATENT DOCUMENTS

| | | | |
|---|---|---|---|
| JP | S55-115959 | U | 8/1980 |
| JP | H04-024857 | Y2 | 6/1992 |
| JP | H06-037949 | Y2 | 10/1994 |

OTHER PUBLICATIONS

Jan. 16, 2018 Written Opinion issued in International Patent Application No. PCT/JP2017/038636.

* cited by examiner

LIQUID CONTAINER AND ANTI-LOOSENING CAP FOR SAME

TECHNICAL FIELD

The present invention relates to a liquid container and a cap therefore, which can put a liquid in, and can prevent leakage when being used repeatedly or being stored for long time.

BACKGROUND OF THE ART

Liquids such as a highly-pure resist liquid used for lithography when manufacturing semiconductor elements or electronic devices for a liquid crystal monitor, or another liquid such as liquid materials for highly-pure medical equipment and medicines or raw materials for chemical products, are put into liquid containers made from resins, and then sealed by screw caps.

Thus cap has a female screw engaging with the male screw provided on a mouth-neck section of a container body, and can seal and prevent to leak a liquid content, by screwing together and tightening the screws and then entwisting a container opening of a mouth-neck section to a buffer seal packing in the cap.

As shown in FIG. 3, when a cap 30 of prior arts tightens towards $R_a$ direction while being set to a container body 40 made from resins, a container opening 32 of a neck section is entwisted to a buffer seal packing 38 towards $R_b$ direction to deform it, and then the cap 30 seals the container opening 32. However, if the cap 30 may be slack though external factors such as undulation by transporting or turning over the container or expansion/constriction by temperature change with time, the content may be leaked.

Especially, for storing or transporting the liquid such as the highly-pure resist liquid whose concentration is had to be strictly controlled, it is necessary to use a cap which does not slacken. Therefore, the cap, which control a reduction of torque for opening thereof by bumps provided onto screw portions for preventing reversion or by elastic portions provided inside a skirt section of the cap made from the resins, is used.

As thus cap, for example, Patent Document 1 discloses a container in which projection thread parts and un-thread parts are alternately formed on a perimeter of an outer surroundings wall of a neck section of a container body and on a perimeter of an inner surroundings wall of a cap body at even regular intervals in a vertical direction towards respective opening edge faces, and both edges of the projection thread are formed as apical edges, and a packing plate for a tight seal is closely attached on an inner bottom side of the cap body and sealed to be provided by the projection thread parts.

And Patent Document 2 discloses a structure for anti-loosening of a cap comprising a container body in which projections having a surroundings shape are provided with large diameter portions in one diametrical direction and small diameter portions in other diametrical directions around base parts of a mouth-neck section for screwing the cap, and the cap made from synthetic resins which is capable to screw the mouth-neck section. When the cap is screwed together and tightened, only an outer side surface of the large diameter portions of the projections is able to be tightly attached to an inner under side of a surroundings wall of the cap or to an inner side of a skirt section provided on an inner under side of a surroundings wall of the cap.

The prior caps have essential problem. When the prior caps are forcibly tightened, screw threads of male screws and female screws are collapsed to be spun around in aimless circles or the cap may be loosed and then cause a leak easily though external factors and so on because of only sealing by screwing them to the buffer seal packing.

PRIOR ART DOCUMENT

Patent Document

[Patent Document 1] Japanese Unexamined Utility Model Application Publication No.Sho55-110453

[Patent Document 2] Japanese Unexamined Utility Model Application Publication No.Sho55-115959

SUMMARY OF THE INVENTION

Problems to be Solved by the Invention

The present invention was made in view of solving the above described problems, and its object is to provide a liquid container, in which an anti-loosening cap having simple features can be screwed to be tightened and can seal strongly, a reduction of torque for opening the cap can be controlled to prevent the loose cap, preservation of a tightly-sealing property can be improved, and leak of the liquid content can be prevented. And another object of the present invention is to provide an anti-loosening cap for the liquid container.

Means for Solving Problems

A liquid container of the present invention developed to achieve the objects described above comprises:

a container body having a male screw provided on an outer periphery of a mouth-neck section rising from an outer surface of the container body; and an anti-loosening cap having a female screw engaging with the male screw, and the anti-loosening cap has a buffer seal material on the inner side of a top plate thereof, and has a flange protruding to a surroundings thereof from an open end portion of an outer cylinder skirt extending from the top plate, a cushion material made from a resin has a protrusion which is provided on the flange and attached onto the outer surface at an outer portion of the flange, a difference in height from an inner surface of the top plate to a top of the protrusion is larger than a difference in height from an end face of a container opening of the mouth-neck section to a contact portion of the outer surface and the protrusion.

In the liquid container, it is preferable that the cushion material is softer than the top plate, the outer cylinder skirt section and the flange all of which becomes unified.

In the liquid container, the cushion material may be integrated or may be heat-welded or adhered with the flange.

In the liquid container, at least a partial portion of the protrusion may be attached to the outer surface.

In the case, it is preferable that the protrusion in the liquid container is continuously or un-continuously provided along an outer edge of the flange with at least a single round.

In the liquid container, it is further preferably that the protrusion is provided at an outer portion than an outer edge of the outer cylinder skirt section or ribs which is provided to surroundings thereof.

In the liquid container, it is preferably that the cushion material is made from a polyolefin resin and/or elastomer.

In the liquid container, it is preferably that the cushion material has 30-90 of Shore A hardness, or 20-50 of Shore D hardness.

In the liquid container, it is preferably that the top plate, the outer cylinder skirt section and the flange are integrated and formed with a polyolefin resin.

In the liquid container, for example, the top plate, the outer cylinder skirt section and the flange has 890-960 kg/m$^3$ of density, and 150-2000 MPa of a flexural modulus of elasticity.

In the liquid container, it is preferably that the container body is made as a single layer or plural layers, and the layer, which is contacted with a liquid filled therein, is made from a polyolefin resin.

An anti-loosening cap for a liquid container of the present invention developed to achieve the objects described above comprises:

a female screw engaging with a male screw which is provided on an outer periphery of a mouth-neck section rising from an outer surface of a container body, wherein a buffer seal material is provided on the inner side of a top plate thereof, a flange protrudes to a surroundings thereof from an open end portion of an outer cylinder skirt extending from the top plate, a cushion material made from a resin has a protrusion which is provided with the flange and attached onto the outer surface at an outer portion of the flange, a difference in height from an inner surface of the top plate to a top of the protrusion is larger than a difference in height from an end face of a container opening of the mouth-neck section to a contact portion of the outer surface and the protrusion.

Effects of the Invention

The liquid container of the present invention prevents a reduction of the torque for opening the cap after tightening the anti-loosening cap, does not make it loose, retains a sealing property, seals the liquid container tightly, and does not allow the liquid content leak.

In the liquid container, the anti-loosening cap comprises the buffer seal material provided on the inner side of the top plate, and the cushion material having the protrusion at the underside of the flange protruding to a surroundings thereof from the outer cylinder skirt. The difference in height from the inner surface of the top plate to the top of the protrusion is larger than the difference in height from the container opening to the contact portion of the outer surface of the container body and the protrusion. Therefore, when the anti-loosening cap is started to be tightened, the protrusion is come into contact as the line-contact to the outside of the container body at first. And then, when the cap is further tightened, the protrusion pushes the outside of the container body and makes the flange incline inside and bend. According to those, the protrusion is deformed, and expresses the friction force by the surface contact thereof to the outside of the container body. Simultaneously, the buffer seal material is suppressed thereby, the container opening of the mouth-neck section of the liquid container can improve the preservation of the tightly-sealing property between the buffer seal material and the container opening. Thus, the anti-loosening cap controls the reduction of the torque for opening the cap, prevents to loosen it thereby and improves the preservation of the tightly-sealing property. The protrusion pushes the outside by tightening them according to screwing together, and then makes the flange bent and makes the container opening hold by the buffer seal material, and thereby the liquid container can be used to be tightly sealed.

Furthermore, the anti-loosening cap used for the liquid container has the protrusion on the cushion material. Thereby, the flange induces to be inclined inside. The anti-loosening cap makes the action and effects improve by the protrusion of the cushion material. The liquid container can prevent the leak, even after it is used repeatedly or for long time.

The tighter the anti-loosening cap tightens under simple features, the stronger the cap can seal inside. Thereby, it prevents to loosen the cap, and controls the reduction of the torque for opening the cap. Both of prevention of loosening thereof and preservation of a tightly-sealing property can be improved, the liquid content can be prevented to be leaked.

MODE FOR CARRYING OUT THE INVENTION

Hereunder, embodiments to practice the present invention in detail will be explained, but the scope of the present invention is not restricted by these embodiments.

Figure 1:
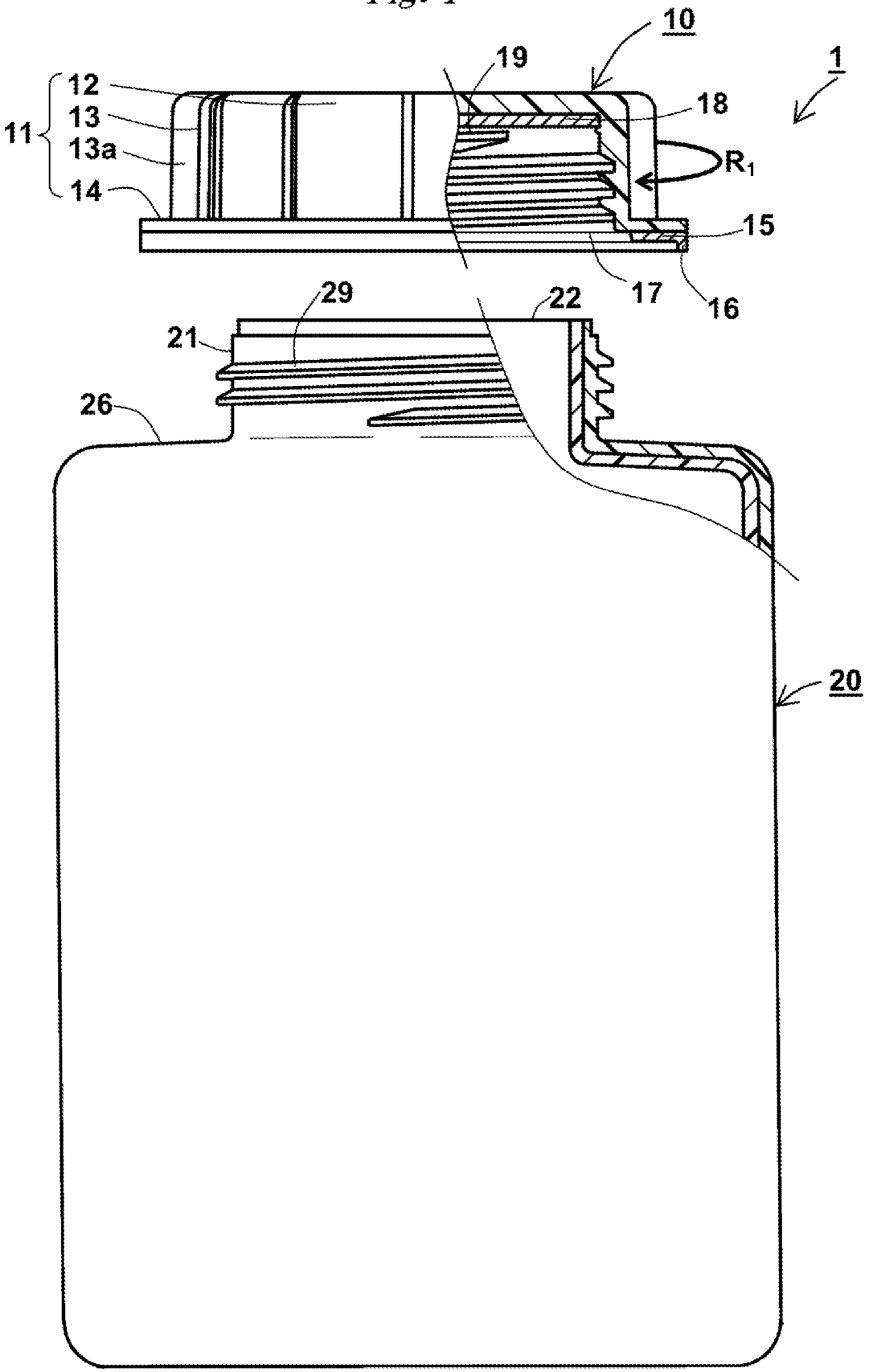
FIG. 1 is a partially-chipped side view showing the liquid container consisting of the anti-loosening cap and the container body which applies the present invention.
Figure 2:
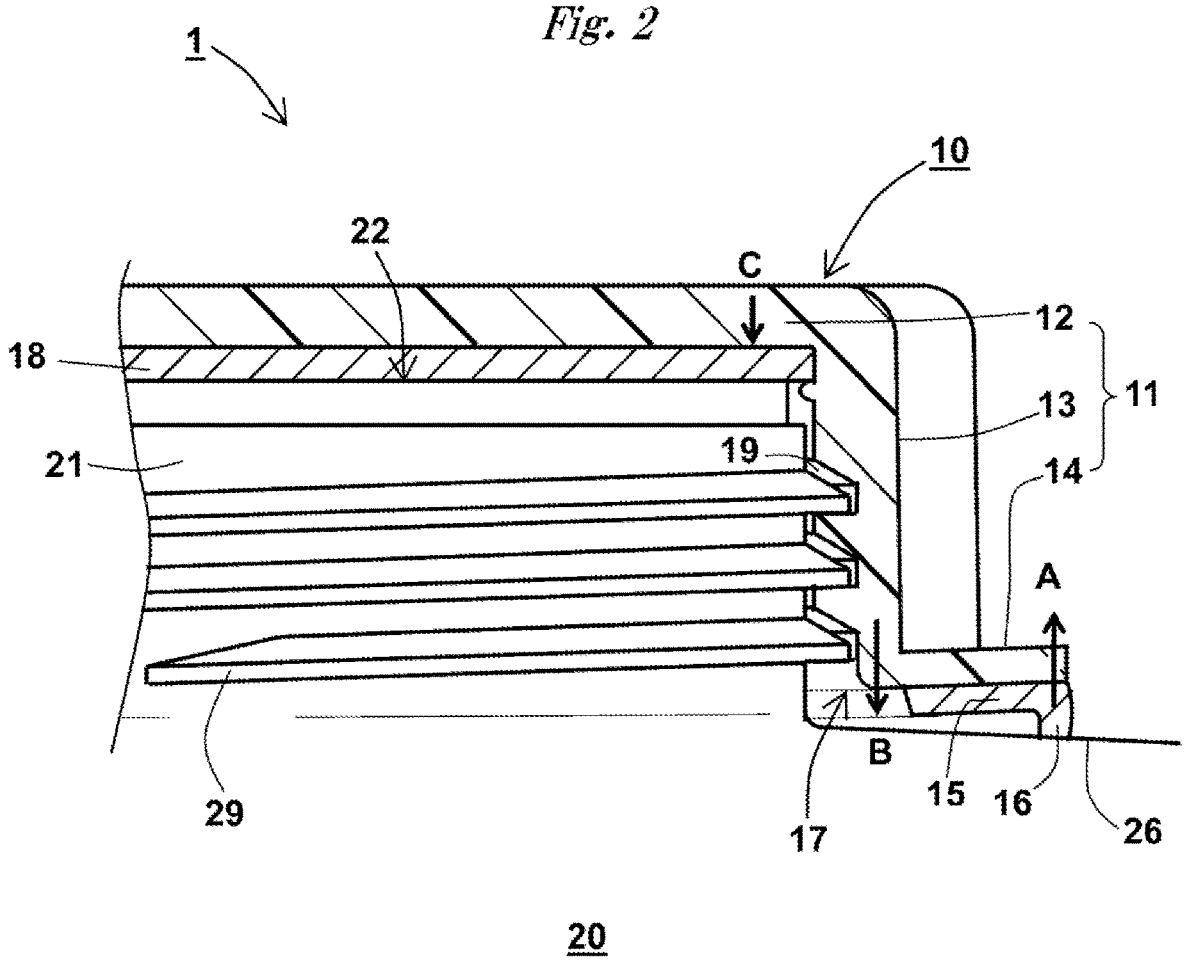
FIG. 2 is a partially-enlarged view showing the liquid container consisting of the anti-loosening cap and the container body which applies the present invention.
Figure 3:
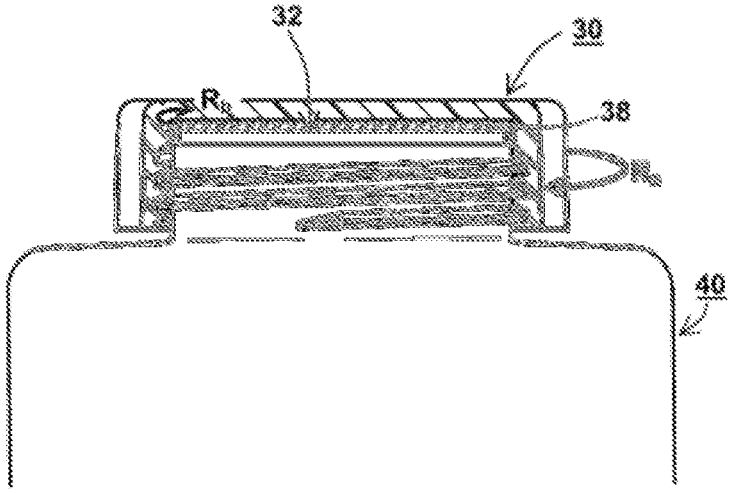
Fig. 3 (RELATED ART)
FIG. 3 is a figure showing liquid container consisting of a prior cap and a container body which does not apply the present invention.

As shown in FIGS. 1 and 2, the liquid container 1 of the present invention is used for sealing the container body 20 storing the liquid by the anti-loosening cap 10.

In a liquid container 1 of the present invention as one preferable embodiment, the anti-loosening cap 10 comprises:

a cap body 11 made from a polyolefin resin consisting of an outer cylinder skirt section 13 having a nearly-cylindrical shape, a top plate 12 which closes the upper edge thereof, a flange 14 made from the same material which has an opening edge portion 17 being opened at a side of an under edge of the outer cylinder skirt section 13 as a side of a container body 20, and protrudes from a side of the opening edge portion 17 to surroundings thereof as a flat ling-shape and extends from the outer cylinder skirt section 13, and a cushion material 15 which is attached to the flange 14.

The cap 10 has a female screw 19 on the inner periphery of the cylinder of the outer cylinder skirt section 13. The female screw 19 can screw with a male screw 29 which is provided on surroundings of a mouth-neck section 21 as a narrower inner cylinder of a nearly-cylindrical shape rising from a shoulder as an outer surface 26 (hereunder, also called as shoulder 26) of the cylindrical container body 20. On an inner side of the top plate 12 in the cap 10, a buffer seal material 18 as a disk, which can contact to the container opening 22 of the mouth-neck section 21 and can prevent to leak a stored liquid, is engaged by claws for prevention of dropping.

The flange 14 of the anti-loosening cap 10 is integrated with the cushion material 15 made from a polyolefin resin or an elastomer resin which is softer than other polyolefin for forming the cap body 11 consisting of the top plate 12, the outer cylinder skirt section 13 and the flange 14 at the side of the container body 20. In the cushion material 15, an external diameter thereof is equal with one of the flange 14, and an interior diameter thereof is larger or equal with one of the flange 14.

An axial length of the male screw 29 having a screw thread is longer than an axial length of the female screw 19 having a cutting screw thread. Thereby, when the anti-loosening cap 10 is just finished to be tightened, the protrusion 16 of the cushion material 15 is pushed on the shoulder 26 of the container body 20.

The protrusion 16 is provided with the cushion material 15. The protrusion 16 extends to the side of the container body 20 along an exterior edge of the flange 14, preferably has an unbroken ling shape and has nearly-rectangle in a cross-sectional surface in a radial direction. Before tightening it, a difference in height from an inner surface of the top plate 12 to a top of the protrusion 16 is larger than a difference in height from the container opening 22 to a contact portion of the shoulder 26 and the protrusion 16. The protrusion 16 of the cushion material 15 has a height so that it locks the container body 20 by a pressure thereof when the anti-loosening cap 10 is tightened by screwing the female screw 19 of the anti-loosening cap 10 and the male screw 29 of the container body 20 and the protrusion 16 is contacted and pushed to the shoulder 26 of the container body 20 and then is slightly deformed according to the elasticity of the cushion material 15. Since the cushion material 15 is soft, the protrusion 16 acts by not the line contact but the surface contact when strongly tightening and pushing it to the shoulder 26 of the container body 20 and deforming it. When the protrusion 16 has the rectangle in a cross-sectional surface, the side of the contacted portion to the shoulder 26 may be horizontal in accordance with the horizontal shoulder 26 or may be horizontal or slanting up to an inclination angle in accordance with the slanting shoulder 26. And the protrusion 16 may be an unbroken or broken protrusion 16 having a U-shape, a reversed V-shape or a W-shape.

As shown in FIG. 2, the flange 14 is approached to the side of the container body 20 by tightening the anti-loosening cap 10. Since the cap body 11, which consists of the top plate 12, the outer cylinder skirt section 13 and the flange 14, is harder than the cushion material 15, the protrusion 16 is pushed and somewhat deformed and collapsed to rebound towards a direction of an arrow A. Since the cap body 11 is approached to the side of the container body 20 by tightening the cap 10, the outer cylinder skirt section 13 of the cap body 11 is deeply screwed to the male screw 29 of the mouth-neck section 21 while the surroundings of the flange 14 does not slump because of the presence of the protrusion 16.

When the anti-loosening cap 10 and the container body 20 are finished to be tightened by screwing thereof, the liquid container 1 is tightly sealed completely thereby. For it, the sum of the difference in the height from the inner surface of the top plate 12 to the top edge of the tightened contact portion of the shoulder 26 and the protrusion 16 (i.e. the difference in height in the inside of the cap body 11 consisting of the top plate 12, the outer cylinder skirt section 13 and the flange 14) and the total thickness of the cushion material 15 which is somewhat deformed and collapsed by tightening is adjusted so as to be corresponded with the sum of the thickness of the buffer seal material 18 which is somewhat deformed and collapsed by tightening inside the cap 10 and the difference in height from the container opening 22 to the top of the contact portion of the shoulder 26 and the protrusion 16 (i.e. corresponding to the effective height of the mouth-neck section 21 in the container body 20.

In consequence, a coupling angle of the outer cylinder skirt section 13 and the flange 14 is slightly bent acutely at the protrusion 16 as a fulcrum, and the flange 14 inclines inside towards the direction of an allow B and bends. The protrusion 16 is further pushed by the repulsive force thereof, and thereby the further contacting frictional force between the protrusion 16 and the shoulder 26 is generated to inhibit moving them. As the result, slackening of the female screw 19 and the male screw 29 can be prevented. Even if the frictional portions contacting the female screw 19 with the male screw 29 are moderately worn away, the repulsive force prevents slackening them because the frictional portions contacting them are kept to be pushed thereby.

And simultaneously, the mouth-neck section 21 of the container body 20 is deeply thrust in along the male screw 29 by tightening the anti-loosening cap 10. As the result, the cap 10 is push towards the direction of an allow C by screwing. Therefore, the container opening 22 digs the buffer seal material 18, and the sealing property is accrued.

The cushion material 15 may consist of the protrusion 16 only. However it is preferable that the cushion material 15 may have a flat base portion having a certain thickness and the protrusion 16 portion having further thickness which is additionally incrassated according to the height thereof, in the light of formability or stability of the protrusion 16 and an adhere strength to the flange 14. The cushion material 15 may be adjusted so that the thickness of the base portion except for the protrusion 16 portion complies with the incline or the shape of the shoulder 26 of the container body 20, and may be moderately shrunk according to the elasticity of the cushion material 15 when the anti-loosening cap 10 is tightened to contact and push the shoulder 26. The cushion material 15 acts by the generated repulsive force while the protrusion 16 is pushed and strained through the elasticity.

The cushion material exerts sufficient effects by mounting the protrusion outside as external as possible than the outer shape of the cap body 11.

On the anti-loosening cap 10, ribs 13*a* may radially project from the surroundings of the outer cylinder skirt section 13 at regular intervals, for example every 30 degree, if necessary. The inner diameter of the cushion material 15 is larger than the surroundings of the outer cylinder skirt section 13, preferably is larger than the circle corresponding to the surroundings of the ribs 13*a*. As regards the cushion material 15, the protrusion 16 is provided along the surroundings of the flange 14, and it is preferable that the protrusion 16 is provided at more external than the surroundings of the outer cylinder skirt section 13 and the surroundings of the ribs 13*a*. Although the surroundings of the protrusion 16 has preferably the diameter as same as the surroundings of the flange 14, the protrusion 16 may be provided at more internal than the surroundings of the flange 14. The diameter of the surroundings of the protrusion 16, for example, is 1.03 times or more of the outer cylinder skirt section 13 or the ribs 13*a*, and is preferably 1.03-1.26 times thereof.

Although the protrusion 16 having the unbroken ring-shape which is a single round along to the surroundings of the flange 14 is shown as the preferable examples, it may have the unbroken ring-shapes which are plural rounds. The protrusion 16 may be broken single or plural intermittent ring-shape, or equal or unequal interval intermittent arcs so as not to decrease the friction force between the container body 20 and shoulder 26.

Although the external bowed shape of the anti-loosening cap is shown so as to have gradual curves of a cantle of the surroundings of the top plate 12, it is not restricted. Although the outer cylinder skirt section 13 of the cap body 11 has a shrinking shape straightly in proportion as the side of the top plate 12 and has a draft taper, it is not restricted.

The container body 20 may have a cylindrical shape, a one-gallon bottle shape, a drum shape, a barrel shape, a rectangular shape, or a parallelepiped shape, all which is made of a single layer or multi layers. The container body 20 has the narrower mouth-neck section 21 raising from the shoulder 26 on the center of the upper part thereof. The shoulder 26 has a gradual inclination spreading flatly or radially so that the skirts of the mouth-neck section 21 as the surrounding surface of the container body 20 evenly contacts the protrusion 16 which may be single or plural rounds. Even if the mouth-neck section 21 rises from anywhere from the outer surface of the container body 20, the aspects thereof are not restricted as the mouth-neck section 21 rising from the center of the upper part of the container body 20. The mouth-neck section 21 may be provided on the border of the shoulder tip of the container body 20.

Incidentally, although the protrusion 16 is shown as the aspects which are evenly contacted to the shoulder 26, the protrusion 16 may contact to the outer surface 26 partially. For example, in a case where the container body 20 has the narrow mouth-neck section 21 rising from the border of the edge of the upper portion or the edge of the upper portion thereof which has the gradually-outward inclination spreading flatly or radially, a part of the protrusion 16 contacts and pushes the outer surface 26 and then makes the flange 14 bent and makes the buffer seal material 18 push in order to tightly seal the container opening 22 and therefore it prevents loosing them sufficiently when the anti-loosening cap 10 is screwed thereto and tightened. Wherefore, the residual protrusion 16 may not contact to the outer surface 26 by straying from the edge of the upper portion or may not contact to the outer surface 26 which inclines outside.

And the anti-loosening cap 10 may be processed with knurling for slip resistance, for example oblique knurling, straight knurling or diagonal knurling, instead of presence of the ribs 13*a* on the cap body 11.

And the size of the anti-loosening cap 10 or the container body 20 is not particularly restricted. However, if they are too small, the sufficient loosening is not generated. If they are too big, the operation for tightening thereof needs an extensive project and lacks versatility.

Therefore, in the anti-loosening cap 10, the maximum outer diameter of the cap body 11, for example, the diameter of the outer cylinder skirt section 13 having no ribs 13*a*, or the outer edge of the ribs 13*a* of the outer cylinder skirt section 13 having the ribs 13*a*, may be φ 20 mm-150 mm, preferably φ 30 mm-130 mm.

On the other hand, the ring-shape flange 14 has a ring breadth (i.e. a difference length between the inner diameter and the outer diameter of the flange) ranging within 3-30 mm, preferably 5-25 mm, more preferably 5-20 mm.

The protrusion 16 having at least one ring-shape of on the flange 14 is provided at the outer position of 1 mm-30 mm, preferably 1-20 mm, more preferably 1-10 mm than the maximum diameter of the cap body 11. The width of the protrusion 16 in the radial directions may be 0.5-5 mm, preferably 0.5-3 mm. The height of the protrusion may be 0.5-5 mm, preferably 0.5-3 mm. If the width in the radial directions is too narrow, the contact area to the shoulder 26 is too narrow and makes an underfriction. On the other hand, the cap cannot be sufficiently tightened by repulsion or the pressing thereof to the shoulder 26 may be dispersed and the retroflexion of the flange 14 becomes week and the tight-sealing property of the buffer seal material 18 may be insufficient, if the width thereof is too wide.

In the anti-loosening cap 10 of the cap body 11, the materials of the top plate 12, the outer cylinder skirt section 13 and the flange 14 are exemplified with polyolefin resins. Concretely, examples of the polyolefin resins are LLDPE; LL as liner low-density polyethylene, which is made by copolymerization of α-olefin with ethylene, for example, ULT-ZEX (available from Prime Polymer Co., Ltd.; registered trademark), NOVATEC-LL (available from Japan Polyethylene Corporation; registered trademark); LDPE as low-density polyethylene, for example, NOVATEC-LD (available from Japan Polyethylene Corporation; registered trademark), SUNTEC-LD (available from Tosoh Corporation; registered trademark); HDPE as high-density polyethylene, for example, HI-ZEX (available from Prime Polymer Co., Ltd.; registered trademark), Nipolon Hard (available from Tosoh Corporation; registered trademark); PP as polypropylene, for example, NOBLEN (SUMITOMO CHEMICAL COMPANY, LIMITED; registered trademark), NOVATEC-PP (Japan Polypropylene Corporation; registered trademark), Prime Polypro (Prime Polymer Co., Ltd.; registered trademark).

The resins of the top plate 12, the outer cylinder skirt section 13 and the flange 14 of the cap body 11 may preferably have the density of 890-960 kg/m$^3$, and the flexural modules of 150-2000 MPa.

The materials of the cushion material 15 of the anti-loosening cap 10 are exemplified with polyolefin resins or elastomers. Concretely, examples of the polyolefin resins are liner low-density polyethylene (LLDPE; LL), for example, Nipolon-Z (available from Tosoh Corporation; registered trademark) as liner low-density polyethylene using C6 comonomer, SUMIKATHENE-L (available from SUMITOMO CHEMICAL COMPANY, LIMITED; registered trademark) as liner low-density polyethylene using C4 comonomer, EVOLUE (available from Prime Polymer Co., Ltd.; registered trademark) as metallocene liner low-density polyethylene (vapor phase method C6-LLDPE; LL); low-density polyethylene, for example, NOVATEC-LD (available from Japan Polyethylene Corporation; registered trademark), SUNTEC-LD (available from Tosoh Corporation; registered trademark). Concretely, examples of elastomers are TPO as olefin elastomer, for example, ESPOLEX TPE (available from SUMITOMO CHEMICAL COMPANY, LIMITED; registered trademark), MILASTOMER (available from Mitsui Chemicals, Inc.; registered trademark), THERMORUN (available from Mitsubishi Chemical Corporation; registered trademark), LEOSTOMER SE no-plasticizer (available from RIKEN TECHNOS CORPORATION; registered trademark); TPS as styrene elastomer, for example, RABALON (available from Mitsubishi Chemical Corporation; registered trademark), EARNESTON (available from Kuraray Plastics Co., Ltd.; registered trademark).

The hardness of the cushion material 15 is preferably 30-90 by Shore A hardness, or 20-50 by Shore D hardness.

Examples of the material of the buffer seal material 18 are a foamed sheet or an elastic sheet, for example, a sheet made from polyethylene foam, concretely, Hi-Sheet (available from Mitsui Chemicals Tohcello, Inc.; registered trademark).

The liquid container 1 consisting of the anti-loosening cap 10 and the container body 20 is manufactured as follows.

The anti-loosening cap 10 is manufactured by using a mold for preparing a desired shape such as a mold having a cavity corresponding to the shape as shown in FIG. 1, through a mold injection method. For example, the cap body 11 and the cushion material 15 are formed through an integrally molding method to obtain the cap 10. After the top plate 12, the outer cylinder skirt section 13 and the flange 14 for the cap body 11 for the cap 10 are integrally molded, the cushion material 15 may be heat-welded thereto, or may be adhered through adhesives thereto to obtain the cap 10. The buffer seal material 18 is engaged on the inner side of the top plate 12 by the claws for prevention of dropping, and then the anti-loosening cap 10 can be obtained.

On the other hand, the container body 20 is manufactured by using a mold for preparing a desired shape such as a mold having a cavity corresponding to the shape as shown in FIGS. 1 and 2, through a blow molding method so as to form the hollow in which the liquid is filled and stored. The container body 20 may be formed as a single layer, or may be formed as plural layers, for example, the multi layers consisting of polyolefin resin inner layer/polyolefin outer layer, or the multi layers consisting of polyolefin resin inner layer/gas barrier resin intermediate layer/polyolefin outer layer. Examples of the material of the container body 20 are high-density polyethylene, for example, SUNTEC (available from Asahi Kasei Corporation; registered trademark), NOVATEC-HD (available from Japan Polypropylene Corporation; registered trademark). The content of the container body 20 is, for example, 5 mL-200 L, preferably 100 mL-50 L. For example, the thickness of the container body 20 may be even anywhere, or different partially. The thickness thereof is 0.3 mm-50 mm, preferably 50 mm at a maximum on the border of the upper edge of the container body and 0.3 mm-30 mm on other portions, more preferably 0.3 mm-15 mm anywhere as a single layer or a same or difference multi layers of the inner layer/the outer layer, and additional intermediate layer of 0.01-1.0 mm preferable 0.02-0.2 mm if necessary.

The container body 20 is manufactured through a blow molding method as follows. After pipe-shaped parison of a single layer or multi layers is formed by an extruder, the extruded parison is sandwiched with molds to make a desired shape of the container and compressed air is blew from a blow pin thereto and then is cooled down.

The liquid container 1 consisting of the anti-loosening cap 10 and the container body 20 is used as follows.

Fluid-form or gel-form liquid such as highly-pure photoresist liquid is poured into the liquid container 20 via the container opening 22 of the mouth-neck section 21. And then, the female screw 19 of the anti-loosening cap 10 is screwed with the male screw 29 of the mouth-neck section 21 of the container body 20 while the cap 10 is started to be tightened in the direction $R_1$.

And first, the protrusion 16 of the cushion material 15 line-contacts to the shoulder 26 of the container body 20. Since the easily-tightening may be loosed in its current state, the anti-loosening cap 10 is tightened further more so that the protrusion 16 is distorted and face-contacted to the shoulder 26. The movement of them is controlled by the friction between the protrusion 16 and the shoulder 26, and the loosening of them is prevented.

It is important that the anti-loosening cap 10 is tightened with the adequate torque, although it is not excessively tightened so that the screw threads of them are not collapsed, and is tightened so that the cap 10 is not excessively loosed.

Thus, the anti-loosening cap 10 can push the buffer seal material 18 from the side of the container opening 22 of the mouth-neck section 21 by tightening them. And the strong frictional force to the container body 20 is generated by the protrusion 16 of the cap 10, therefore the cap 10 is hard to loose. Accordingly, the tightened force can be held, and the reduction of the torque for opening the cap can be prevented. If the screwed state is loosened up with time, the reduction of the torque for opening the cap is prevented by the protrusion 16 with the cushion material 15. Further, since the protrusion 16 makes the tightly-sealing property of the buffer seal material 18 does not decrease according to the elasticity of the cushion material 15, the tightly-sealing property can be sufficiently kept up.

Since the cushion material 15 having the protrusion 16 with the plasticity in the anti-loosening cap 10 is provided at the side of the opening edge portion 17 of the cap, it does not affect the tightly-sealing property while the reduction of the torque of opening the cap is prevented.

The anti-loosening cap 10 does not affect the tightly-sealing property because of the protrusion having the bendability when the cushion material 15 contacts the shoulder 26 of the container body 20. Further, the protrusion having the bendability can surface-contacts the shoulder 26 with deforming it according to the shape of the shoulder 26. Thereby, the anti-loosening cap 10 exerts the frictional force, and prevents the reduction of the torque of opening the cap.

However, a cap of the prior arts having no cushion material does not contact to the shoulder of the container at the underside of the opening portion of the cap, therefore a buffer seal material only conducts to tightly-seal. Accordingly a sealing property affects the strength of tightly-sealing by the buffer seal material directly. As the result, it cannot adapt the reduction of a torque of opening a cap.

EMBODIMENTS

Hereunder, preferable examples of an anti-loosening cap 10 and a container body 20 which apply the present invention and were manufactured, and examples of liquid container 1 which was manufactured by using them and evaluated, are mentioned. And comparative examples of caps, which do not apply the present invention and were manufactured and evaluated, are mentioned.

First of all, a raw material of a cushion material 15, and a position and a shape of protrusion thereof are examined.

Examples 1-6

As shown if FIGS. 1 and 2, a liquid container 1 was manufactured by using various resins as follows. An anti-loosening cap 10 having of a cushion material 15 and the cap body 11 consisting of a top plate 12, an outer cylinder skirt section 13 and a flange 14, in which a protrusion 16 molded integrally was projected from a flat portion of a cushion material 15 along surroundings of a flange 14 with a single round and was integrally molded, was formed through a mold injection. And a container body 20 was formed through a blow molding. Thereby, the liquid container 1 was obtained.

to manufacture it.

The resins for manufacturing them are listed in Table 1.

TABLE 1

| | Raw Material | Maker | Density [kg/m³] | Bend Elastic Constant [MPa] | Duro meter JIS-K7215 A Hardness | Duro meter JIS-K7215 D Hardness |
|---|---|---|---|---|---|---|
| Cap Body | Liner Low-density Polyethylene 1 (LL1) | A Company | 945 | 660 | — | 60 |
| | Polypropylene 1 (PP1) | B Company | 910 | 1700 | N.D. | N.D. |
| Cushion Material | Liner Low-density Polyethylene 2 (LL2) | C Company | 900 | 50 | — | 44 |
| | Olefin Elastomer 1 (TPO1) | B Company | 880 | N.D. | 60 | — |
| | Olefin Elastomer 2 (TPO2) | B Company | 880 | N.D. | 70 | — |
| | Olefin Elastomer 3 (TPO3) | D Company | 880 | N.D. | 78 | — |
| | Liner Low-density Polyethylene 3 (LL3) | A Company | 938 | 550 | — | 59 |
| Buffer Seal Material | Packing with 2 mm Thickness (Packing) | E Company | — | — | — | — |
| Container Body | High-density Polyethylene | F Company | 957 | 1400 | — | 71 |

N.D.: no Data

The raw materials, shapes or specifications of the portions of the anti-loosening cap 10 in respective Examples are listed in below Table 2.

TABLE 2

| | Examples | | | | | | Comparative Examples | | | | | |
|---|---|---|---|---|---|---|---|---|---|---|---|---|
| | 1 | 2 | 3 | 4 | 5 | 6 | 1 | 2 | 3 | 4 | 5 | 6 |
| Cap Body; RawMaterial | LL1 | LL1 | LL1 | LL1 | LL1 | PP1 | LL1 | LL1 | LL1 | LL1 | LL1 | LL1 |
| Flange; Width(mm) | 5.0 | 5.0 | 5.0 | 5.0 | 5.0 | 5.0 | 5.0 | 5.0 | 5.0 | 5.0 | 10.0 | 5.0 |
| Buffer Seal Material | Packing | Packing | Packing | Packing | Packing | Packing | Packing | Packing | Packing | Packing | Packing | Packing |
| Cushion Material; RawMaterial | LL2 | LL2 | LL2 | LL2 | TPO2 | TPO2 | — | LL2 | LL2 | LL2 | LL2 | TPO2 |
| Cushion Material; Thickness (mm) | 4.0 | 4.0 | 4.0 | 4.0 | 4.0 | 4.0 | — | 4.0 | 4.0 | 4.0 | 4.0 | 4.0 |
| Cushion Material; Shore Hardness | Shore D 44 | Shore D 44 | Shore D 44 | Shore D 44 | Shore A 70 | Shore A 70 | — | Shore D 44 | Shore D 44 | Shore D 44 | Shore D 44 | Shore A 70 |
| Protrusion Position (mm) | 1.0 | 4.0 | 3.5 | 3.0 | 4.0 | 3.5 | — | — | −2.0 | 0.0 | 4.0 | −2.0 |
| Protrusion; Height(mm) | 2.0 | 2.0 | 2.0 | 2.0 | 2.5 | 2.5 | — | — | 2.0 | 2.0 | 2.0 | 2.0 |
| Protrusion; Width(mm) | 0.5 | 1.0 | 1.5 | 2.0 | 1.0 | 1.5 | — | — | 1.0 | 0.5 | 6.0 | 1.0 |
| Torque Retention Rate (%) | 42 | 46 | 47 | 38 | 56 | 71 | 34 | 65 | 28 | 43 | 30 | 60 |
| Presence or Absence of Leak | Absence | Absence | Absence | Absence | Absence | Absence | Absence | Presence | Presence | Presence | Presence | Presence |

Incidentally, in Table 2, the width of the flange 14 means the width in the radial directions. The thickness of the cushion material 15 means the total thickness including the protrusion 16. The position of the protrusion 16 means the difference between the maximum diameter of the cap and the inner diameter of the protrusion 16. The height of the protrusion 16 means the height difference between the flat portion without the protrusion 16 in the cushion material 15 and the top portion of the protrusion 16. The width of the protrusion 16 means the maximum width of the protrusion 16 in the radial directions.

The evaluations of performance of the liquid container 1 were carried out by measuring the toque retention rate and checking the presence or absence of the leak.

The measuring tests of the torque retention rate was carried out by measuring the torque for opening the cap after tightening the anti-loosening cap 10 with the torque of 15 N·m and keeping it for 1 day. It was calculated by the mathematical formula: torque retention rate (%)=(torque for opening cap)/(torque for tightening it)*100. When the torque retention rate is 35% or more, it is estimated that the anti-loosening cap 10 have the appropriate range to prevent loosening it.

The determination of the presence or absence of the leak was carried out by the following procedures, when manufacturing the anti-loosening cap 10. The liquid container 1 was fully filled with the water and then was tightened under the torque of 15 N·m, and was laid down. After 1 day, it was risen up and opened. It was checked whether the female screw 19 of the anti-loosening cap 10 and the male screw 29 of the container body 20 were wet with the water or not. When they were not wet by the water, it was judged as the absence of the leak. And when they were wet by the water, it was judged as the presence of the leak.

As regards the respective Examples of the liquid container 1, the summarized results of measuring the torque retention rate and checking the presence or the absence of the leak are indicated in Table 2.

Comparative Examples 1-6

Anti-loosening caps and liquid containers of Comparative Examples 1-6, which does not apply the present invention, were manufactured and evaluated as well as Examples 1-6 instead of using respective resins listed in Table 1 and using raw materials and shapes or specifications of the respective portions and materials as shown in Table 2. The results of them are summarized in Table 2.

As shown in Table 2, the anti-loosening caps 10 in Examples 1-6, which applies the present invention, indicated high torque retention rate, and does not show the leak.

Results of Examples 1-6 and Comparative Examples 1-6 indicate that it is important that the cushion material 15 in the anti-loosening cap 10 is located at the specific position of the protrusion 16.

When the protrusion 16 was provided at the outer position from the maximum of the cap body than 1-30 mm, the flange 14 of the anti-loosening cap 10 was curved to incline inside and thereby achieved to prevent reduction of the torque for opening the cap under the cases of pressing an axial force by tightening it.

On the other hand, as shown in Comparative Example 1 which does not apply the present invention, when there was no cushion material, torque retention rate was significantly decreased.

As shown in Comparative Example 2, when the cap provided with the flat cushion material having no protrusion was used, reduction of the torque retention rate was controlled by the large friction of the cushion material. However when tightening it, the buffer seal material on the inside of the top plate was hard to be compressed by the container opening of the container body because of less deformation of the cushion material. Therefore, tightly-sealing property was too weak not to improve sealing property and caused the leak.

In the caps of Comparative Examples 3, 4 and 6, since the protrusion of the cushion material was located underneath the maximum external diameter of the cap body, the protrusion was overloaded and did not increase the axial force anymore by tightening it before the container opening of the container body compressed the buffer seal material. As the results, the flange could not be bent and also tightening of the cap could be insufficient. And then the sealing property became insufficient and caused to leak.

As shown in Examples 1-6, when the anti-loosening cap 10 had 5 mm or less of the width of the protrusion, the flange 14 was bent above according to closing to the surroundings thereof by compressing the axial force through tightening it. And further, the axial force could be compressed and high sealing property could be exerted. Therefore it achieved to prevent reduction of torque for opening the cap.

On the other hand, as shown in Comparative Example 5, when the width of the protrusion was over 5 mm, the protrusion was overloaded and does not increase the axial force by tightening it before the container opening of the container body compressed the buffer seal material. As the results, when the width of the protrusion was over 5 mm, the flange could not be bent by excess stress and the axial force was insufficient. Thereby, the sealing property became insufficient to cause the leak.

The results of Examples 1-6 and Comparative Examples 1-6 indicate that it is important that the width of the protrusion 16 of the cushion material 15 in the anti-loosening cap 10 was 0.5-5 mm. Next, the hardness of the cushion material 15 was examined Examples 7-14 and Comparative Example 7

Anti-loosening caps of Examples 7-14 which applied the present invention and of Comparative Example 7 which did not apply the present invention, were manufactured as well as Examples 1-6 instead of using raw materials for cushion materials listed in Table 3 and using shapes of the protrusions as shown in Table 3. And then the liquid containers were evaluated. Their results summarized in Table 3.

TABLE 3

| | Example | | | | | | | | Comp. Exam. |
|---|---|---|---|---|---|---|---|---|---|
| | 7 | 8 | 9 | 10 | 11 | 12 | 13 | 14 | 7 |
| Cap Body; RawMaterial | LL1 | LL1 | LL1 | LL1 | LL1 | LL1 | LL1 | LL1 | LL1 |
| Flange; Width(mm) | 5.0 | 5.0 | 5.0 | 5.0 | 5.0 | 5.0 | 5.0 | 5.0 | 5.0 |
| Buffer Seal Materia | Packing | Packing | Packing | Packing | Packing | Packing | Packing | Packing | Packing |
| Cushion Material; RawMaterial | LL2 | LL2 | TPO1 | TPO1 | TPO2 | TPO2 | TPO3 | TPO3 | LL3 |
| Cushion Material; Thickness (mm) | 4.0 | 4.0 | 4.0 | 4.0 | 4.0 | 4.0 | 4.0 | 4.0 | 4.0 |
| Cushion Material; Shore Hardness | 44(D) | 44(D) | 60(A) | 60(A) | 70(A) | 70(A) | 78(A) | 78(A) | 59(D) |
| Protrusion; Width(mm) | 1.5 | 2.0 | 1.5 | 2.0 | 1.5 | 2.0 | 1.5 | 2.0 | 1.5 |
| Protrusion; Position (mm) | 3.5 | 3.0 | 3.5 | 3.0 | 3.5 | 3.0 | 3.5 | 3.0 | 3.5 |
| Protrusion; Height (mm) | 2.5 | 2.5 | 2.5 | 2.5 | 2.5 | 2.5 | 2.5 | 2.5 | 2.5 |
| Torque Retention Rate (%) | 47 | 38 | 45 | 40 | 54 | 56 | 48 | 52 | 33 |
| Presence or Absence of Leak | Absence | Absence | Absence | Absence | Absence | Absence | Absence | Absence | Presence |

As shown in Table 3, it is important that the cushion material 15 has moderately soft hardness of 90 or less of Shore A hardness, or 50 or less of Shore D hardness. In thus case, when the anti-loosening cap 10 is tightened to be compressed by the axial force, the protrusion 16 is deformed and the contacting area onto the shoulder 26 of the container body 20 is increased and the torque is retained. However, if the hardness of the cushion material 15 is too hard, the protrusion is loaded before the container opening of the container body compresses the buffer seal material and then cannot increase the axial force anymore by tightening it.

Accordingly, the liquid container 1 consisting of the anti-loosening cap 10 and the container body 20, which apply the present invention, can achieve to retain the sealing property and to prevent the reduction of the torque for opening the cap by the protrusion 16 compatibly, and can prevent to leak the liquid contents.

INDUSTRIAL APPLICABILITY

The anti-loosening cap and the liquid container using it, both of which is the present invention, are used for filling and storing the liquid contents, preserving it for long time without the leak as keeping high quality, and then taking the liquid contents out when manufacturing the products after opening it. And the liquid contents are liquid content materials of high quality chemical products for example photoresists which are used for manufacturing electronic device products such as integrated circuits, semiconductors and liquid crystals, or fluid or gelled liquid contents as raw content materials for the products such as raw materials of high quality medical equipments, medicines and chemical products.

EXPLANATIONS OF LETTERS OR NUMERALS

1: liquid container, 10: anti-loosening cap, 11: cap body, 12: top plate, 13: outer cylinder skirt section, 13*a*: rib, 14: flange, 15: cushion material, 16: protrusion, 17: opening edge portion, 18: buffer seal material, 19: female screw, 20: container body, 21: mouth-neck section, 22: container opening, 26: outer surface, 29: male screw, 30: cap, 32: container opening, 38: buffer seal packing, 40: container body.

What is claimed is:

1. A liquid container comprising:

a container body having a male screw provided on an outer periphery of a mouth-neck section rising from an outer surface of the container body; and an anti-loosening cap having a female screw engaging with the male screw, wherein the anti-loosening cap has a buffer seal material on the inner side of a top plate thereof, and has a flange protruding to a surroundings thereof from an open end portion of an outer cylinder skirt extending from the top plate, a cushion material made from a resin has a protrusion which is provided on the flange and configured to attach onto the outer surface of the container body at an outer portion of the flange, and a difference in height from an inner surface of the top plate to a top of the protrusion is larger than a difference in height from an end face of a container opening of the mouth-neck section to a contact portion of the outer surface of the container body and the protrusion.

2. The liquid container according to claim 1, wherein the cushion material is softer than the top plate, the outer cylinder skirt section and the flange all of which becomes unified.

3. The liquid container according to claim 1, wherein the cushion material is integrated or is heat-welded or adhered with the flange.

4. The liquid container according to claim 1, wherein at least a partial portion of the protrusion is attached to the outer surface of the container body.

5. The liquid container according to claim 1, wherein the protrusion is continuously or un-continuously provided along an outer edge of the flange with at least a single round.

6. The liquid container according to claim 1, wherein the protrusion is provided at an outer portion than an outer edge of the outer cylinder skirt section or ribs which is provided to surroundings thereof.

7. The liquid container according to claim 1, wherein the cushion material is made from at least one of a polyolefin resin and an elastomer.

8. The liquid container according to claim 1, wherein the cushion material has 30-90 of Shore A hardness, or 20-50 of Shore D hardness.

9. The liquid container according to claim 1, wherein the top plate, the outer cylinder skirt section and the flange are integrated and formed with a polyolefin resin.

10. The liquid container according to claim 1, wherein the top plate, the outer cylinder skirt section and the flange has 890-960 kg/m$^3$ of density, and 150-2000 MPa of a flexural modulus of elasticity.

11. The liquid container according to claim 1, wherein the container body is made as a single layer or plural layers, and the layer, which is contacted with a liquid filled therein, is made from a polyolefin resin.

12. An anti-loosening cap for a liquid container comprising:

a female screw engaging with a male screw which is provided on an outer periphery of a mouth-neck section rising from an outer surface of a container body, wherein a buffer seal material is provided on the inner side of a top plate thereof, a flange protrudes to a surroundings thereof from an open end portion of an outer cylinder skirt extending from the top plate, a cushion material made from a resin has a protrusion which is provided on the flange and configured to attach onto the outer surface of the container body at an outer portion of the flange, a difference in height from an inner surface of the top plate to a top of the protrusion is larger than a difference in height from an end face of a container opening of the mouth-neck section to a contact portion of the outer surface of the container body and the protrusion.

* * * * *